United States Patent [19]

Widmer

[11] 4,310,147

[45] Jan. 12, 1982

[54] COOLED COMPONENTS FOR FURNACES

[76] Inventor: Colin F. Widmer, 67 Levenside, Stokesley, Middlesbrough, Cleveland, England, TS9 5BH

[21] Appl. No.: 145,063

[22] PCT Filed: Dec. 20, 1978

[86] PCT No.: PCT/GB78/00055

§ 371 Date: Aug. 23, 1979

§ 102(e) Date: Aug. 13, 1979

[87] PCT Pub. No.: WO79/00431

PCT Pub. Date: Jul. 12, 1979

[51] Int. Cl.[3] ..... C21B 7/10

[52] U.S. Cl. ..... 266/190

[58] Field of Search ..... 266/190–194

[56] References Cited

U.S. PATENT DOCUMENTS

| | | | |
|---|---|---|---|
| 1,673,053 | 0/1928 | Ohba | 122/6.6 |
| 2,686,666 | 8/1954 | Tau | 266/190 |
| 3,652,070 | 3/1972 | Sagara | 266/46 |
| 3,681,051 | 8/1972 | Takashima et al. | 75/58 |
| 3,690,633 | 9/1972 | Andonier et al. | 266/283 |

FOREIGN PATENT DOCUMENTS

| | | |
|---|---|---|
| 148071 | of 1902 | Fed. Rep. of Germany . |
| 2601727 | 7/1977 | Fed. Rep. of Germany . |

*Primary Examiner*—P. D. Rosenberg

*Attorney, Agent, or Firm*—Cushman, Darby & Cushman

[57] ABSTRACT

To improve the resistance to abrasion during use of cooled components, such as tuyeres and stack and bosh coolers, in furnaces a refractory or a metal with greater abrasion resistance than the metal, which is normally copper or a copper alloy, used for the main body of the component is introduced during casting into the cast walls of the components. The added material may be in the form of one or more segments, a mesh, or in discrete particles and is located at or just below the surface at the nose (24) of the component. Examples of the materials which may be used are particles (44,48) of so-called "hard metals" which comprise hard sintered carbides, such as tungsten carbide; stainless steel meshes and expanded elements (10,40,42) of varying thickness; and various compressed refractories capable of withstanding the thermal shock in a matrix of copper.

5 Claims, 5 Drawing Figures

COOLED COMPONENTS FOR FURNACES

TECHNICAL FIELD

This invention relates to cooled components used in furnaces, particularly blast furnaces.

BACKGROUND ART

Amongst the cooled components used in blast furnaces are the coolers, such as stack and bosh coolers, which are built into the refractory lining of the furnace, and tuyeres. These components are normally castings of copper or copper alloy.

The noses of tuyeres and coolers inevitably become exposed to erosion by the burden of ore, coke, limestone, etc., in the blast furnace, the exposure becoming progressively greater as the furnace lining wears away.

DISCLOSURE OF INVENTION

The object of the present invention is to improve the resistance to abrasion during use of cooled components for furnaces. For this purpose according to the present invention there is introduced into the cast walls of such components during casting a refractory or a metal with greater abrasion resistance than the metal used for the main body of the component. The added material may be a refractory or a metal in the form of one or more segments, a mesh or in discrete particles and is located at or just below the surface at the nose of the component.

The materials which may be used include (a) so-called "hard metal" which comprises hard sintered carbides, such as tungsten carbide, (b) stainless steel meshes of varying thickness, and (c) various compressed refractories capable of withstanding the thermal shock in a matrix of copper.

The materials concerned are introduced into the casting by locating them in position in the mould before casting is commenced.

A particularly suitable element is expanded metal from stainless steel or heat resistant steel. An expanded metal element has a certain amount of depth as well as length and breadth and the spaces between the steel strips can be varied to give the desired gap, filled with the cast copper or other material, thus providing the desired good heat conduction from the exterior of the element to the cooling medium.

BRIEF DESCRIPTION OF THE DRAWINGS

Various forms of the invention will now be further described with reference to the accompanying drawings in which.

BEST MODE OF CARRYING OUT THE INVENTION

Figure 1:
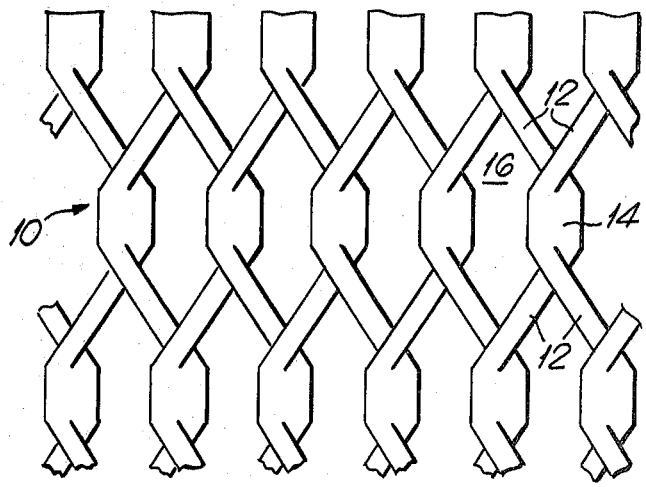
FIG. 1 is part of an expanded steel element which can be used for the purposes of the invention.

FIG. 1 of the drawings shows part of an expanded stainless steel element, generally designated by the reference numeral 10. This has been made in the usual way by cutting and expanding a sheet of stainless steel to give a lattice of strips 12 adjoined by flat nodes 14 which, as they are twisted out of the plane of the paper as seen in FIG. 1, give some depth to the structures as well as length and breadth. Spaces 16 between the strips 12 and nodes 14 will be filled by the cast metal in the finished article and will allow good conduction of heat to the surface of the cast component.

The expanded sheet 10 can be cut to size and bent round very easily to form a curved or cylindrical shape.

Suitable gauge for the stainless steel sheet from which the element 10 is made is 20 gauge (0.91 mm), and the stainless steel may be, for example, according to BS1449 EN58B.

Figure 2:
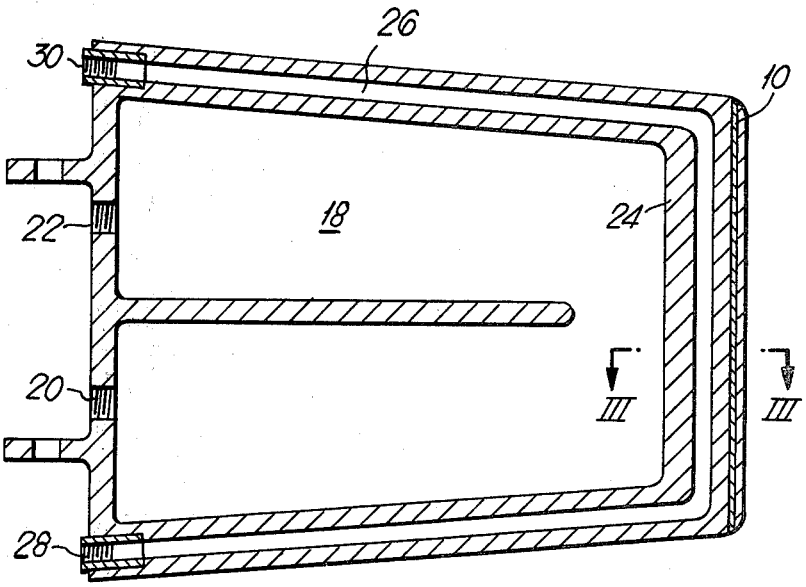
FIG. 2 is a side view of a blast furnace cooler according to the invention.
Figure 3:
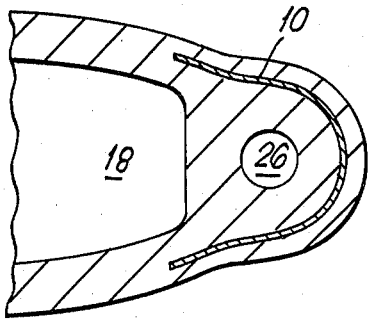
FIG. 3 is a section on a larger scale taken on the line III—III of FIG. 2.

FIGS. 2 and 3 show, on a smaller scale than that used in FIG. 1, a cooler, such as a bosh cooler, for a blast furnace. The cooler shown has a main cooling compartment 18 with inlet and outlet apertures 20 and 22, the nose end 24 of the cooler being cooled by means of a cast-in water pipe 26 having separate inlet and outlet 28 and 30.

The characterising feature of the cooler is the expanded stainless steel element 10 which is included in the casting by locating it in position in the casting mould and casting the copper of the cooler round it. As shown in FIG. 2 it extends at length across the whole width of the nose of the cooler just underneath the surface and has been bent to go round the cast-in pipe 26 as shown in FIG. 3.

Figure 4:
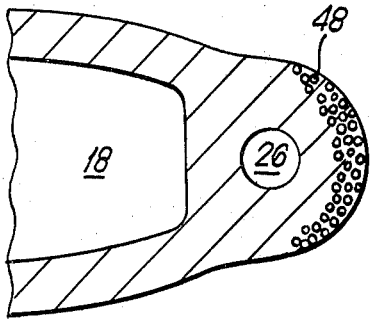
FIG. 4 is a similar part section showing a different type of abrasion resistant material.

In FIG. 4 can be seen the nose of a cooler in which, instead of using an expanded steel element 10, the abrasion resistant material consists of particles 48 of hard metal, i.e. mainly sintered tungsten carbide, such as is used for carbide tips of cutting tools. No particular size or shape is needed for this particulate material and the particles may in fact be waste hard metal from the manufacture of carbide tips or used tips. The material 48 is embodied in the cooling element by placing it at the bottom of the mould or attached to the surface of the mould when the cooler is cast, so that the elements are embodied in the cast copper.

Figure 5:
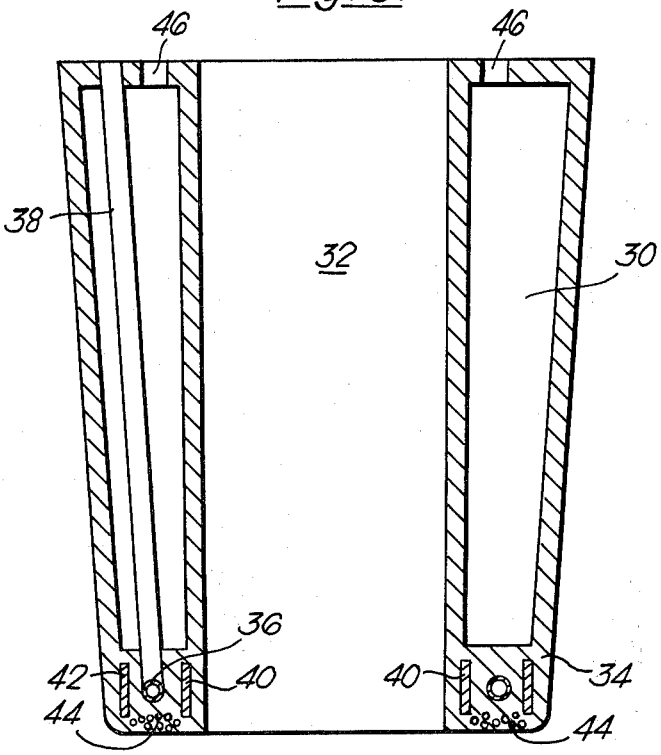
FIG. 5 is a section through a tuyere according to the invention.

FIG. 5 shows a tuyere of the sort having a main cooling chamber 30 surrounding an air-passage 32. The cooling chamber 30 has inlet and outlet apertures 46. The nose 34 of the tuyere is cooled by a separate cooling pipe 36 having an inlet pipe 38 leading thereto and a similar outlet pipe not seen in the section of FIG. 5.

The nose is reinforced with two rings of expanded metal, an inner ring 40 which is inside the nose cooling pipe 36 and an outer ring 42 which surrounds the said pipe. Additionally hard metal particles 44 are embedded in the copper of the tuyere forwardly of the cooling pipe 36.

It will be understood that any constructional form of cooler or tuyere can be used, the essential feature according to the invention being the provision of the abrasion resistant material at the nose of the device.

Instead of using stainless steel, another form of heat-resistant steel could also be used, for example, according to AISA 430/S15.

I claim:

1. In a cast metallic component of high heat conductivity, and having cooling fluid passageways therein, for location in the lining of a lined furnace, the component having a main body portion and a nose portion to be directed towards the interior of the furnace, the improvement comprising an element chosen from the group consisting of a mesh element and an expanded metal element embedded in said nose portion, said element having greater abrasion resistance than the metal of said cast component to reinforce said nose portion against abrasion by the charge in the furnace.

2. The structure defined in claim 1 wherein the component is a cooler for the wall of a blast furnace.

3. The structure defined in claim 1 wherein the component is a tuyere.

4. The structure defined in claim 1, 2 or 3 wherein the element is of stainless steel.

5. The structure defined in claim 1, 2 or 3 wherein the element is of heat resistant steel.

* * * * *